US005604572A

United States Patent [19]

Suzuki et al.

[11] Patent Number: 5,604,572

[45] Date of Patent: *Feb. 18, 1997

[54] DEVELOPING APPARATUS HAVING DEVELOPING AGENT ACCOMMODATING CARTRIDGE AND CARTRIDGE FOR ACCOMMODATING DEVELOPING AGENT FOR USE IN DEVELOPING APPARATUS

[75] Inventors: Mitsuo Suzuki; Isamu Terashima; Katsumi Kumada, all of Hitachi, Japan

[73] Assignee: Hitachi, Ltd., Tokyo, Japan

[ * ] Notice: The term of this patent shall not extend beyond the expiration date of Pat. No. 5,491,537.

[21] Appl. No.: 563,211

[22] Filed: Nov. 27, 1995

Related U.S. Application Data

[63] Continuation of Ser. No. 124,393, Sep. 21, 1993, Pat. No. 5,491,537.

[30] Foreign Application Priority Data

Sep. 22, 1992 [JP] Japan ..... 4-252887

[51] Int. Cl.[6] ..... G03G 15/06

[52] U.S. Cl. ..... 399/119; 118/251; 118/260; 399/282

[58] Field of Search ..... 355/245, 260, 355/251, 253, 259, 261; 118/653, 656–658, 651, 661; 222/DIG. 1

[56] References Cited

U.S. PATENT DOCUMENTS

| | | | |
|---|---|---|---|
| 4,967,234 | 10/1990 | Tani et al. | 355/260 |
| 4,974,023 | 11/1990 | Aimoto | 355/245 |
| 4,990,968 | 2/1991 | Kusuda | 355/245 X |
| 4,998,140 | 3/1991 | Satou et al. | 355/245 |
| 5,079,589 | 1/1992 | Shibata et al. | 355/245 |
| 5,103,264 | 4/1992 | Bhagat | 355/245 |
| 5,221,943 | 6/1993 | Hasegawa | 355/245 |
| 5,491,537 | 2/1996 | Suzuki et al. | 355/245 |

FOREIGN PATENT DOCUMENTS

| | | |
|---|---|---|
| 0220286 | 9/1988 | Japan . |
| 0054470 | 3/1989 | Japan . |

*Primary Examiner*—Robert Beatty
*Attorney, Agent, or Firm*—Antonelli, Terry, Stout & Kraus, LLP

[57] ABSTRACT

A developing magnet roller is provided on a developing frame, and a developing agent accommodating cartridge and a toner accommodating cartridge member are fitted detachably into the developing frame. The toner accommodating cartridge member is fitted detachably into the developing agent accommodating cartridge. A developing agent is recovered in the developing agent accommodating cartridge. The developing agent and the developing agent accommodating cartridge are exchanged together from a developing apparatus. The new developing agent accommodated in the exchanged new developing agent accommodating cartridge is circulated by the developing magnet roller. The exchange for the developing agent in the developing apparatus can be realized without the lowering of the developing performance.

11 Claims, 7 Drawing Sheets

DEVELOPING APPARATUS HAVING DEVELOPING AGENT ACCOMMODATING CARTRIDGE AND CARTRIDGE FOR ACCOMMODATING DEVELOPING AGENT FOR USE IN DEVELOPING APPARATUS

This application is a Continuation application of application Ser. No. 08/124,393, filed Sep. 21, 1993.

BACKGROUND OF THE INVENTION

1. Field of the Invention

The present invention relates to a developing apparatus having a developing agent accommodating cartridge, and a cartridge for accommodating a developing agent for use in a developing apparatus.

The present invention relates to a developing apparatus having a developing agent accommodating cartridge for developing an electrostatic latent image in an electro-photography copying machine or in an electro-photography printer, and a cartridge for accommodating a developing agent for use in a developing apparatus and, particular, to an exchanging means for exchanging the developing agent in, the developing agent accommodating cartridge.

2. Prior Art

In a conventional developing apparatus, this developing apparatus adopts a two-component developing agent in which the toners are mixed with carriers at a predetermined rate. According to the magnetic brush formed by adhering the developing agent to a developing magnet roller, an electrostatic latent image is developed by brushing and sliding a surface of the electrostatic latent image.

The toners adhered on the surfaces of the carriers are adsorbed by the electrostatic latent image and the electrostatic latent image is converted or developed to the toner image. The toners are consumed during the developing process. The toners being consumed during the developing process are supplemented using a toner accommodating cartridge.

In the above stated conventional developing apparatus, since the carriers are rubbed with the toners and further the toners are adhered repeatedly to the surfaces of the carriers, accordingly some part of the toners is fixed or spent on the surfaces of the carriers. Furthermore, then the peeling of a coating material from surfaces of the carriers occurs.

As a result, in the above stated conventional developing apparatus the surface characteristic e.g., electrical charging, of the carriers changes, or the toners are crushed. Accordingly, the electric charging characteristic of the toners is lowered and then the life of the developing agent becomes exhausted.

The life of the developing agent is affected according to the property of matter of the toners, the property of matter of the carriers, an amount of the developing agent and/or the construction of the developing apparatus, etc. However, the life of the developing agent corresponds to effect the copies of several tens of thousands of pages or the printing of several tens of thousands of pages.

When the developing agent becomes exhausted, it is necessary to exchange the developing agent accommodated in the developing apparatus. However, the extracting work for extracting the developing agent from the developing apparatus is troublesome.

So as to carry out easily an exchange of work developing agent, an electro-photography apparatus in which the developing apparatus itself is exchanged has been proposed. This kind of the electro-photography apparatus is disclosed in, for example, Japanese patent laid-open No. 136,767/1985.

As stated above, in the conventional developing apparatus, there is a problem in which when the developing agent becomes exhausted, the extracting work for extracting the developing agent from the developing apparatus is troublesome. Further, there is another problem that in the electro-photography apparatus when the developing apparatus itself is exchanged, the exchanging components have a high price.

In addition to the above stated problems, in the electro-photography apparatus in which it is necessary to exchange the developing apparatus itself, it is very difficult to maintain high accuracy with respect to the opposing gap between the developing magnet roller and the surface of the electrostatic latent image, and thereby it is difficult to maintain the stable developing characteristic of the developing agent in the developing apparatus.

SUMMARY OF THE INVENTION

An object of the present invention is to provide a developing apparatus having a developing agent accommodating cartridge, and a cartridge for accommodating a developing agent for use in a developing apparatus, wherein the developing agent can be exchanged without a reduction in the developing performance when the life of the developing agent becomes exhausted.

Another object of the present invention is to provide a developing apparatus having a developing agent accommodating cartridge, and a cartridge for accommodating a developing agent for use in a developing apparatus, wherein exchange of developing agent can be performed easily using a developing agent accommodating cartridge.

According to the present invention, a developing apparatus having a developing agent accommodating cartridge comprising a developing agent supplying roller, a toner accommodating cartridge member for supplementing the toners, a developing magnet roller for brushing and sliding an electrostatic latent image formation surface, a developing agent containing member for receiving the developing agent supplying roller, the toner accommodating cartridge member and the developing magnet roller, and a driving means for driving the developing agent supplying roller and the developing magnet roller.

The developing agent containing member comprises a developing agent accommodating cartridge member and a developing means frame member.

The developing agent accommodating cartridge member comprises a toner accommodating cartridge member receiving space for fitting the toner accommodating cartridge member, a developing agent accommodating space for accommodating the developing agent, a developing agent sending-out port for sending out the developing agent to the developing magnet roller, and a developing agent recovering port for recovering the developing agent to the developing agent accommodating space.

The developing means frame member comprises a developing agent cartridge member receiving space for supporting the developing magnet roller and for fitting the developing agent accommodating cartridge member, a developing agent receiving port for supplying the developing agent by receiving the developing agent sent out from the developing agent sending-out port of the developing agent accommodating cartridge member, and a developing agent discharging port for sending out the developing agent to the developing agent recovering port of the developing agent accommodating cartridge member.

The driving means comprises a developing agent recovery controlling means, and the developing agent recovery controlling means drives the developing magnet roller at the condition when the rotation of the developing agent supplying roller is stopped.

According to the present invention, a developing agent accommodating cartridge for use in a developing apparatus comprises a toner accommodating cartridge receiving space for fitting a toner accommodating cartridge member, a developing agent accommodating space for accommodating a developing agent, a developing agent accommodating container for accommodating the developing agent and for throwing in the developing agent into the developing agent accommodating space, a developing agent supplying roller provided in the developing agent accommodating space, a developing agent sending-out port for sending out the developing agent to a developing magnet roller from the developing agent supplying roller, and a developing agent recovering port for recovering the developing agent to the developing agent accommodating space.

According to the present invention, a developing apparatus comprises a toner accommodating cartridge unit for supplementing the toners, a developing agent accommodating cartridge unit having a developing magnet roller for receiving the toner accommodating cartridge unit, a developing means frame unit having a developing agent supplying roller for receiving the developing agent accommodating cartridge unit, and a driving means for driving the developing magnet roller of the developing agent accommodating cartridge unit and the developing agent supplying roller of the developing means frame unit.

The toner accommodating cartridge unit comprises a cartridge case for accommodating supplementing the toners, and a toner supplementing port for supplementing the toners to the developing agent accommodating cartridge unit.

The developing agent accommodating cartridge unit comprises a developing magnet roller, a toner accommodating cartridge unit receiving space for fitting the toner accommodating cartridge unit, a developing agent accommodating space for accommodating the developing agent, a developing agent sending-out port for sending out the developing agent to the developing magnet roller of the developing agent accommodating cartridge unit, and a developing agent recovering port for recovering the developing agent to the developing agent accommodating space.

The developing means frame unit comprises a developing agent supplying roller, a developing agent cartridge unit receiving space for supporting the developing magnet roller of the developing agent accommodating cartridge unit and for fitting the developing agent accommodating cartridge unit, a developing agent receiving port for supplying the developing agent by receiving the developing agent sent out from the developing agent sending-out port of the developing agent accommodating cartridge unit, and a developing agent discharging port for sending out the developing agent to the developing agent recovering port of the developing agent accommodating cartridge unit.

The driving means comprises a developing agent recovery controlling means, and the developing agent recovery controlling means drives the developing magnet roller of the developing agent accommodating cartridge unit at the condition when the rotation of the developing agent supplying roller of the developing means frame unit is stopped.

In the present invention, the developing agent accommodating cartridge unit can recover the developing agent on the surface of the developing magnet roller and this developing agent accommodating cartridge unit including the developing magnet roller can be exchanged by separating the developing means frame unit.

According to the present invention, it is possible to exchange easily the developing agent without reducing the developing characteristic in the developing apparatus.

In the present invention, the developing agent cartridge provides the developing agent accommodating container which accommodates the developing agent in the interior portion and this developing agent accommodating container is provided mountable in the developing agent cartridge.

According to the present invention, since the new developing agent in the developing apparatus can be thrown in the developing agent accommodating space, thereby exchange of developing agent in the developing apparatus can be performed easily using the developing agent accommodating cartridge.

BRIEF DESCRIPTION OF THE DRAWINGS

Each of FIG. 1A, FIG. 1B

FIG. 1C is a vertically cross-sectional side view showing one embodiment of a developing means frame unit of the developing apparatus according to the present invention;

Each of FIG. 2A

FIG. 2B is a vertically cross-sectional side view showing one embodiment of a developing means frame unit of the developing apparatus according to the present invention;

Each of FIG. 7A

FIG. 7B is a vertically cross-sectional side view showing one embodiment of the developing means frame unit of the developing apparatus according to the present invention;

DESCRIPTION OF THE INVENTION

Figure 1A:
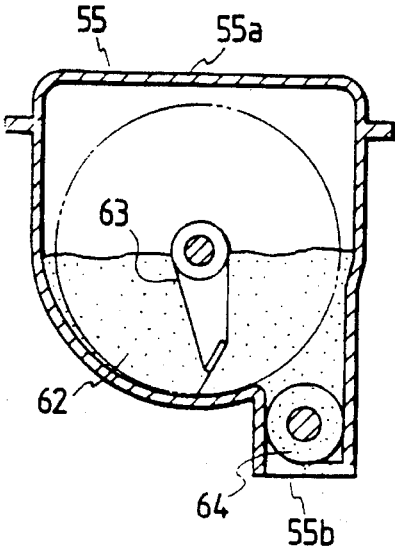
FIG. 1A is a vertically cross-sectional side view showing one embodiment of a toner accommodating cartridge unit of the developing apparatus according to the present invention.

One embodiment of a developing apparatus having a developing agent accommodating cartridge and a cartridge for accommodating a developing agent for use in a developing apparatus according to the present invention will be explained referring to the drawings.

Figure 10:
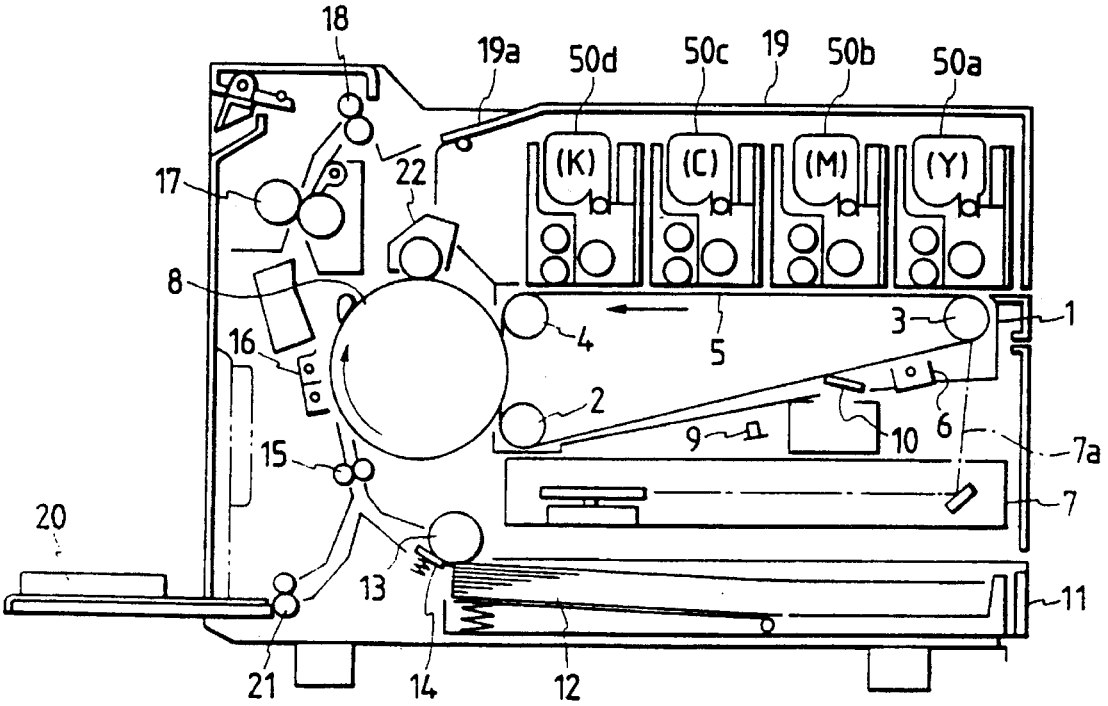
FIG. 10 is a vertically cross-sectional side view showing one embodiment of a color printer using the developing apparatus having the developing agent accommodating cartridge according to the present invention.

FIG. 10 is a vertically cross-sectional side view showing a color printer using a developing apparatus having a developing agent accommodating cartridge according to the present invention.

The color printer comprises a photosensitive belt unit 1, a belt driving roller 2, following rollers 3 and 4, and a photosensitive belt 5. The photosensitive belt unit 1 provides the belt driving roller 2 and the following rollers 3 and 4. The photosensitive belt 5 is formed by an organic photoconducting layer.

This photosensitive belt 5 is hung surrounding the belt driving roller 2 and the following rollers 3 and 4 and the photosensitive belt 5 can rotate around the belt driving roller 2 and the following rollers 3 and 4 through the drive of the belt driving roller 2.

The color printer comprises further a charging means 6 and a laser beam exposing means 7. The charging means 6 charges uniformly the rotative photosensitive belt 5 and the laser beam exposing means 7 exposes the photosensitive belt 5 using the laser beam 7*a*, this leaser beam 7*a* is modulated strongly or weakly according to the printing image information signal. Accordingly the electrostatic latent image is formed on a surface of the photosensitive belt 5.

Four developing apparatuses according to the present invention are installed along the rotative photosensitive belt 5 in which the electrostatic latent image is formed.

Four developing apparatuses comprises a first developing apparatus 50*a* in which a developing agent of a first color (yellow) is used, a second developing apparatus 50*b* in which a developing agent of a second color (magenta) is used, a third developing apparatus 50*c* in which a third color (cyan) is used, and a fourth developing apparatus 50*d* in which a developing agent of a fourth color (black) is used, respectively.

The first developing apparatus 50*a* converts the electrostatic latent image to the toner image of the yellow color by acting the developing agent to the photosensitive belt 5 when the electrostatic latent image area is rotated in opposite to the first developing apparatus 50*a*. The above electrostatic latent image area is formed according to the exposing by the laser beam 7*a*, this laser beam 7*a* is modulated according to the yellow image information signal.

The second developing apparatus 50*b* converts the electrostatic latent image to the toner image of the magenta color by attracting the developing agent to the photosensitive belt 5 when the electrostatic latent image area is rotated in opposition to the second developing apparatus 50*b*. The above electrostatic latent image area is formed according to the exposing by the laser beam 7*a*, and this laser beam 7*a* is modulated according to the magenta image information signal.

The third developing apparatus 50*c* converts the electrostatic latent image to the toner image of the cyan color by attracting the developing agent to the photosensitive belt 5 when the electrostatic latent image area is rotated in opposition to the third developing apparatus 50*c*. The above electrostatic latent image area is formed according to the exposing by the laser beam 7*a* which is modulated according to the cyan image information signal.

The fourth developing apparatus 50*d* converts the electrostatic latent image to the toner image of the black color by attracting the developing agent to the photosensitive belt 5 when the electrostatic latent image area rotates in opposition to the fourth developing apparatus 50*d*. The above electrostatic latent image area is formed according to the exposing by the laser beam 7*a*, and this laser beam 7*a* is modulated according to the black image information signal.

The color printer comprises further an intermediate transferring drum 8, an eraser 9 and a belt cleaner 10.

The intermediate transferring drum 8 is installed to rotate by contacting with the photosensitive belt 5 between the belt driving roller 2 and the following roller 4. The intermediate transferring drum 8 transfers by overlapping in turn each color toner image which is formed respectively on the photosensitive belt 5. The intermediate transferring drum 8 completes the color toner image which is superimposed by each color toner image.

The eraser 9 exposes uniformly the surface of the photosensitive belt 5 which rotates further after the transfer of the toner image and removes the charge on the surface of the photosensitive belt 5. The belt cleaner 10 removes the residual toners on the surface of the photosensitive belt 5 on which the charge has been removed.

The color printer comprises further a recording paper feeding cassette 11, a recording paper feeding roller 13, a recording paper separating member 14 and a resist roller 15.

The recording paper feeding cassette 11 accommodates the laminated recording papers 12 therein, and the recording paper feeding roller 13 extracts a most upper rank recording paper 12 within the laminated recording papers 12.

When the recording paper 12 is extracted from the recording paper laminated state, by cooperating with the recording paper separating member 14, one sheet of recording paper 12 of the upper side recording papers 12 is separated and this one sheet recording paper 12 is sent toward the resist roller 15.

The resist roller 15 adjusts the posture and the transferring timing of the recording paper 12 by receiving a tip of the send-out recording paper 12. Accordingly, the resist roller 15 carries out again the transportation of the recording paper 12 according to the timing which is consistent with the color toner image, and this color toner image is formed on the surface of the intermediate transferring drum 8 and is rotated.

The color printer comprises further a transferring means 16, a fixing means 17, a recording paper discharging roller 18, a top cover 19, a recording paper discharging tray 19*a*, a manual operating recording paper inserting tray 20, a recording paper transporting roller 21 and a drum cleaner 22.

The transferring means 16 produces charges for transferring to a rear face of the transported recording paper 12 which is sent out from the resist roller 15 and is moved by contacting to the intermediate transferring drum 18. The transferring means 16 assists to transfer the color toner image of the surface of the intermediate transferring drum 8 to the surface of the recording paper 12.

The fixing means 17 adheres or fixes the color toner image to the recording paper 12 by heating and fusing the color toner images when the color toner image passes through on the transferred and transported recording paper 12. The recording paper discharging roller 18 discharges the recording papers 12 in which the color toner image is fixed, toward the recording paper discharging tray 19*a* which is formed on the top cover 19.

The manual operating recording paper inserting tray 20 is used so as to feed paper fed inconveniently from the recording paper feeding cassette 11. The recording paper transporting roller 21 pulls in the manual operating inserting recording paper which is fed from the manual operating recording paper inserting tray 20 and sends out the manual operating inserting recording paper to the resist roller 15 similarly to the feeding of the recording paper from the recording paper feeding cassette 11.

The drum cleaner 22 removes the color toner image formation on the surface of the intermediated transferring drum 8. The drum cleaner 22 acts on the surface of the intermediate transferring drum 8 after transfer of the completed color toner image in which the transfer of the completed color toner image has been completed so as to remove the residual toners on the surface of the intermediate transferring drum 8.

Next, the above stated four developing apparatuses 50*a*–50*d* according to the present invention will be explained in detail however, since each of four developing apparatuses 50*a*–50*d* has respectively the same structure, only the first developing apparatus 50*a* structure will be exemplified.

Figure 1B:
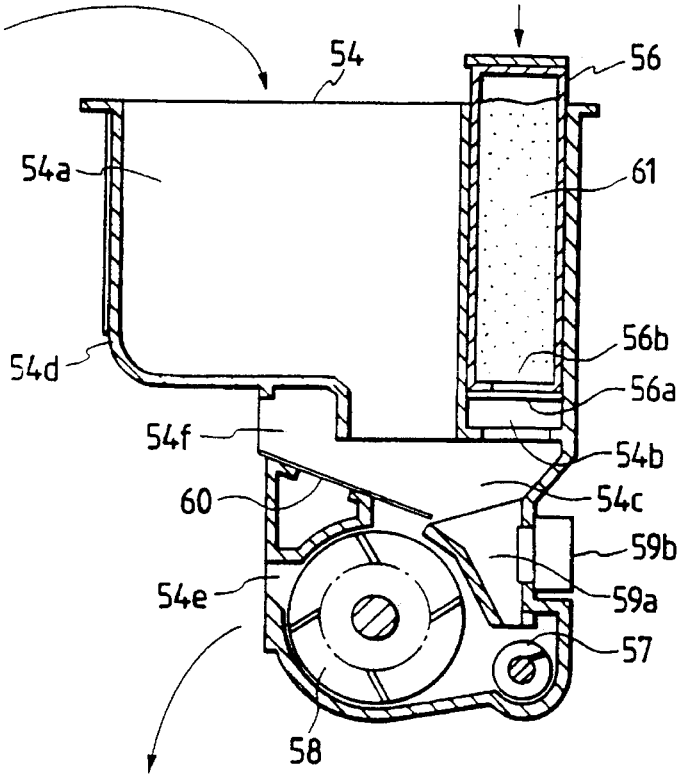
FIG. 1B is a vertically cross-sectional side view showing one embodiment of a developing agent accommodating cartridge unit of the developing apparatus according to the present invention.
Figure 1C:
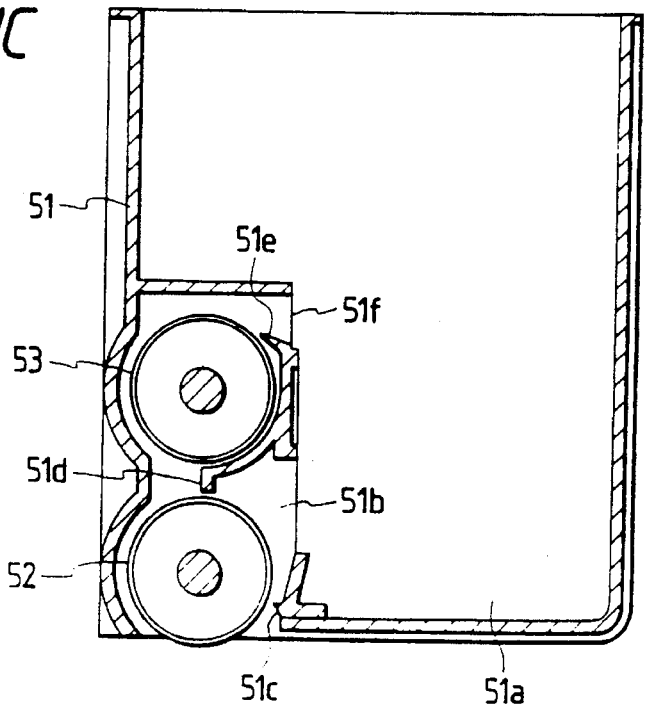
FIG. 1C is a vertically cross-sectional side view showing one embodiment of a developing apparatus having a developing agent accommodating cartridge according to the present invention, in which each of the construction unit parts of the developing apparatus is separated, respectively.

FIGS. 1A–1C are vertically cross-sectional side views showing the separating states of three construction unit parts of the first developing apparatus 50*a*. The three unit parts are a developing means frame unit 51, a developing agent accommodating cartridge unit 54 and a toner accommodating cartridge unit 55.

A substantial-box shape developing means frame unit 51 is one construction unit part of the first developing apparatus 50*a*. The developing means frame unit 51 shown in FIG. 1C is a non-exchangeable component which can be fixed to a printer main frame of the color printer.

The developing means frame unit 51 installs a developing magnet roller 52 and a developing agent discharging and transporting magnet roller 53. The developing magnet roller 52 is arranged in opposition to the photosensitive belt 5 with a predetermined developing gap.

The developing means frame unit 51 has a developing agent cartridge receiving space 51*a*, a developing agent receiving port 51*b*, a doctor blade 51*c*, a developing agent sending-in scrapper 51*d*, a developing agent scraping scrapper 51*e* and a developing agent discharging port 51*f*.

The developing agent cartridge receiving space 51*a* is fitted detachably and freely to the developing agent accommodating cartridge unit 54. The developing agent cartridge receiving port 51*b* receives the developing agent which is sent out from the developing agent accommodating cartridge unit 54. The developing agent accommodating cartridge unit 54 is fitted to the developing agent cartridge receiving space 51*a* and supplies the sending-out developing agent to the developing magnet roller 52. A developing agent containing member comprises the accommodating cartridge unit 54 and the developing means frame unit 51.

The doctor blade 51*c* regulates the height of the developing brush which is formed by the developing agent adsorbed on the surface of the developing magnet roller 52. The developing agent sending-in scrapper 51*d* scrapes the developing agent from the developing magnet roller 52 and the developing agent sending-in scrapper 51*d* sends out the developing agent toward the developing agent discharging and transporting magnet roller 53.

The developing agent scrapper 51*e* scrapes the developing agent, which is transported by the developing agent discharging and transporting magnet roller 53, from the developing agent discharging transporting magnet roller 53. The developing agent discharging port 51*f* discharges so as to return the developing agent scrapped by the developing agent discharging and transporting magnet roller 53 to the developing agent accommodating cartridge unit 54.

The developing agent discharging and transporting magnet roller 53 is installed so as to obtain a height of developing agent at an uppermost location of roller 53, that is higher than a height of stored developing agent, for recovery of the developing agent; accordingly, in a case it is possible to obtain a height necessary for the recovery of the developing agent only by the installation of the developing magnet roller 52. In such a case the developing agent discharging and transporting magnet roller 53 in the first developing apparatus 50*a* can be omitted;

The developing agent accommodating cartridge unit 54 shown in FIG. 1B is one construction unit part of the first developing apparatus 50*a*. The developing agent accommodating cartridge unit 54 is an exchangeable component which can fit to the above stated developing agent cartridge receiving space 51*a* of the developing means frame unit 51.

The developing agent accommodating cartridge unit 54 has a substantial box shape cartridge frame 54*d*. This cartridge frame 54*d* is divided into two portions comprising of an upper portion and a lower portion.

In the upper portion of the cartridge frame 54*d*, the two spaces are arranged dividable and separately, two spaces comprising a toner cartridge receiving space 54*a* for fitting the toner accommodating cartridge unit 55 and a developing agent container receiving space 54*b* for fitting a developing agent accommodating container 56.

The toner cartridge receiving space 54*a* is formed at an upper portion and the developing agent container receiving space 54*b* is formed at a lower portion. Besides, in the lower portion of the cartridge frame 54*d*, one space comprising of a developing agent accommodating space 54*c* is formed.

In the developing agent accommodating space 54*c*, a developing agent stirring roller 57 and a developing agent stirring and supplying roller 58 are provided. The developing agent stirring roller 57 makes the mixture of the carriers and the toners uniform by stirring the developing agent accommodated in the developing agent accommodating space 54*c* and makes the electro-charging with the frictional state. The developing agent stirring and supplying roller 58 sends out the developing agent toward the developing magnet roller 52 by stirring further the developing agent.

The developing agent accommodating cartridge unit 54 comprises further a developing agent sending-out port 54*e*, a developing agent recovering port 54*f*, a toner concentration detecting case 59*a*, a toner concentration detecting element 59*b* and a guiding space 60.

The developing agent sending-out port 54*e* is arranged nearly in opposition to the developing receiving port 51*b* which is formed on the developing means frame unit 51. The developing agent sending-out port 54*e* sends out the developing agent sent out from the developing agent stirring and supplying roller 58 toward the developing agent receiving port 51*b* of the developing means frame unit 51.

The developing agent recovering port 54*f* is arranged nearly in opposition to the developing agent receiving port 51*f* which is formed on the developing means frame unit 51. The developing agent recovering port 54*f* recovers the developing agent discharged from the developing agent discharging port 51*f*.

The guiding space 60 guides the developing agent recovered from the developing agent recovering port 54*f* to the toner concentration detecting case 59*a*. The toner concentration detecting element 59 is mounted on the toner concentration detecting case 59*a*.

The above stated developing agent accommodating container 56 has a new developing agent in an interior portion and is installed in advance in the developing agent accommodating cartridge unit 54. The developing agent accommodating container 56 has a developing agent throwing-in port 56*b* at a lower portion. This developing agent throwing-in port 56*b* is shielded by a sealing member 56*a*. The sealing member 56*a* can be peeled off by pulling out from the lateral direction.

The toner accommodating cartridge unit 55 shown in FIG. 1A is one construction unit part of the first developing apparatus 50*a*. The toner accommodating cartridge unit 55 is an exchangeable component which can be fixed to the toner cartridge receiving space 54*a* formed on the developing agent accommodating cartridge unit 54. The toner accommodating cartridge unit 55 comprises a substantial box shape toner cartridge case 55*a* and a toner supplementing port 55*b*.

In this toner cartridge case 55*a*, the supplementing toners 62 are accommodated in the interior portion. The cartridge case 55*a* comprises a toner stirring blade 63 and a toner supplementing roller 64. From the toner supplementing port 55*b*, the supplementing toners are supplemented to the developing agent accommodated in the developing agent receiving space 54*c* of the developing agent accommodating cartridge unit 54 according to falling the supplementing toners 62.

Figure 2A:
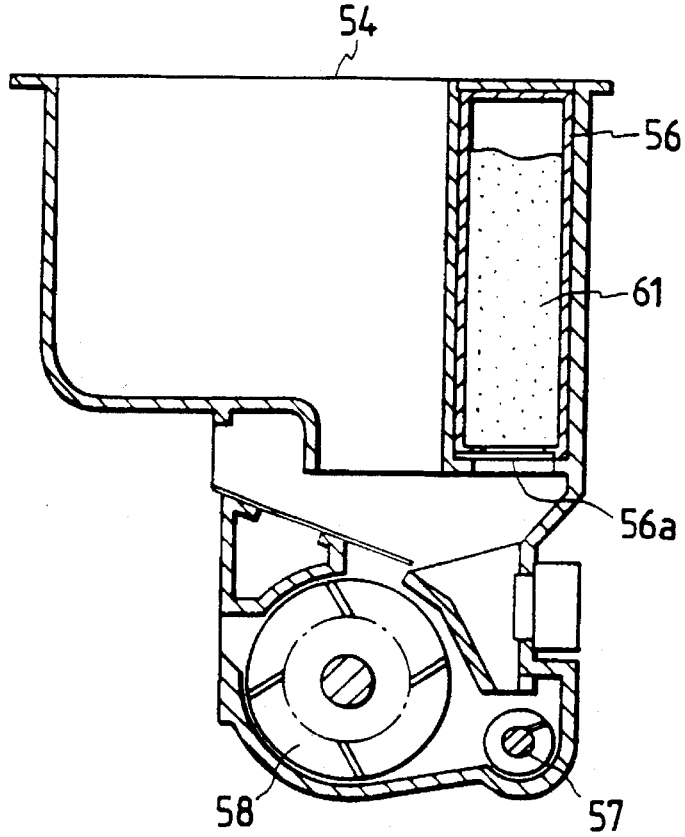
FIG. 2A is a vertically cross-sectional side view showing one embodiment of the developing agent accommodating cartridge unit of the developing apparatus according to the present invention.
Figure 2B:
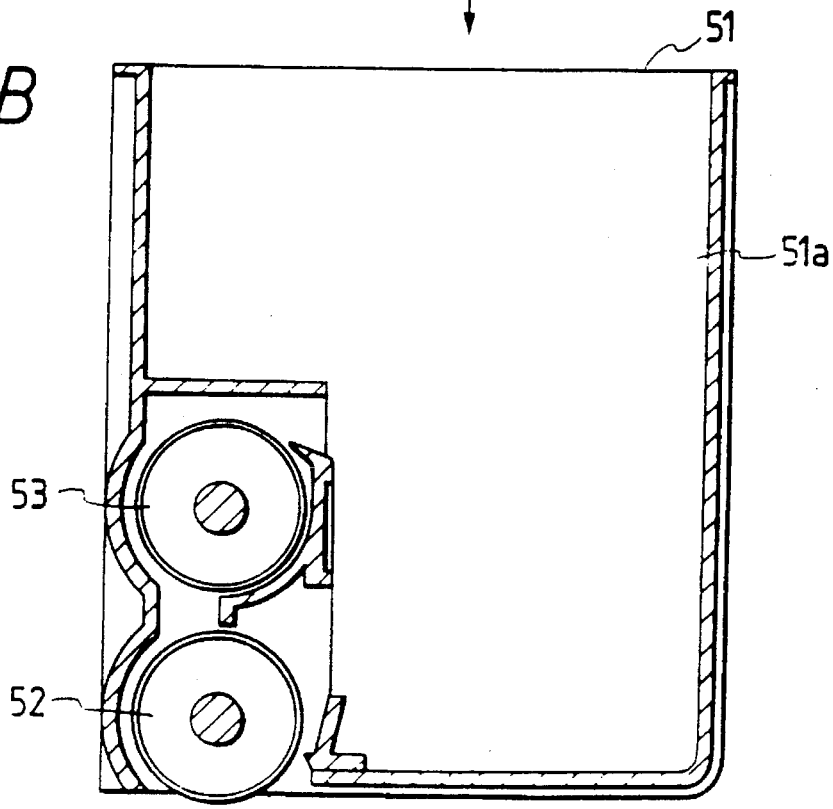
FIG. 2B is a vertically cross-sectional side view showing one embodiment of the working state for fitting the developing agent accommodating cartridge unit into the developing means frame unit in the developing apparatus having the developing agent accommodating cartridge according to the present invention.
Figure 3:
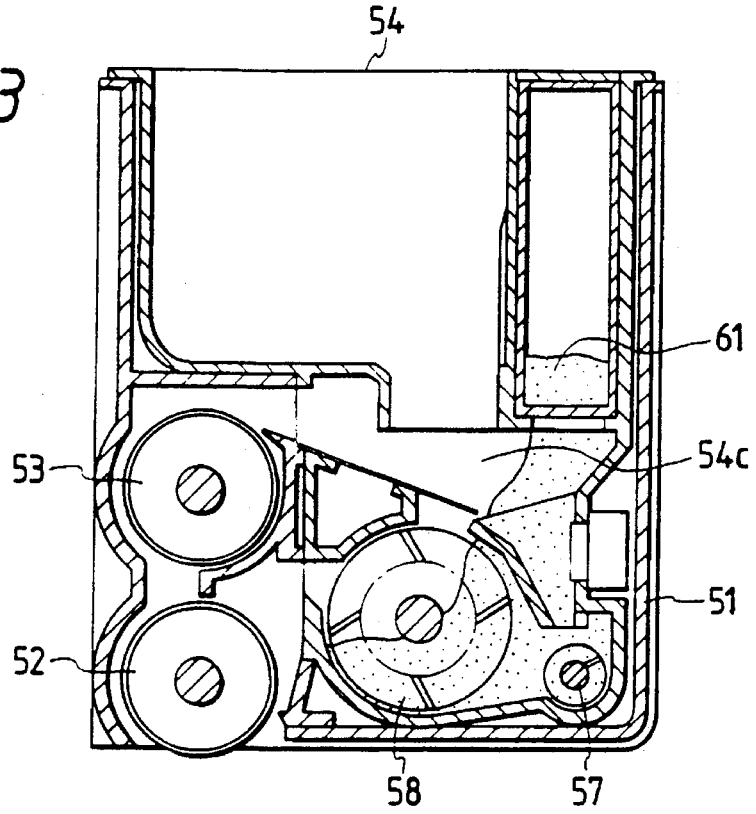
FIG. 3 is a vertically cross-sectional side view showing one embodiment of the fitting state of the developing agent accommodating cartridge unit and the developing means frame unit according to the present invention.
Figure 4:
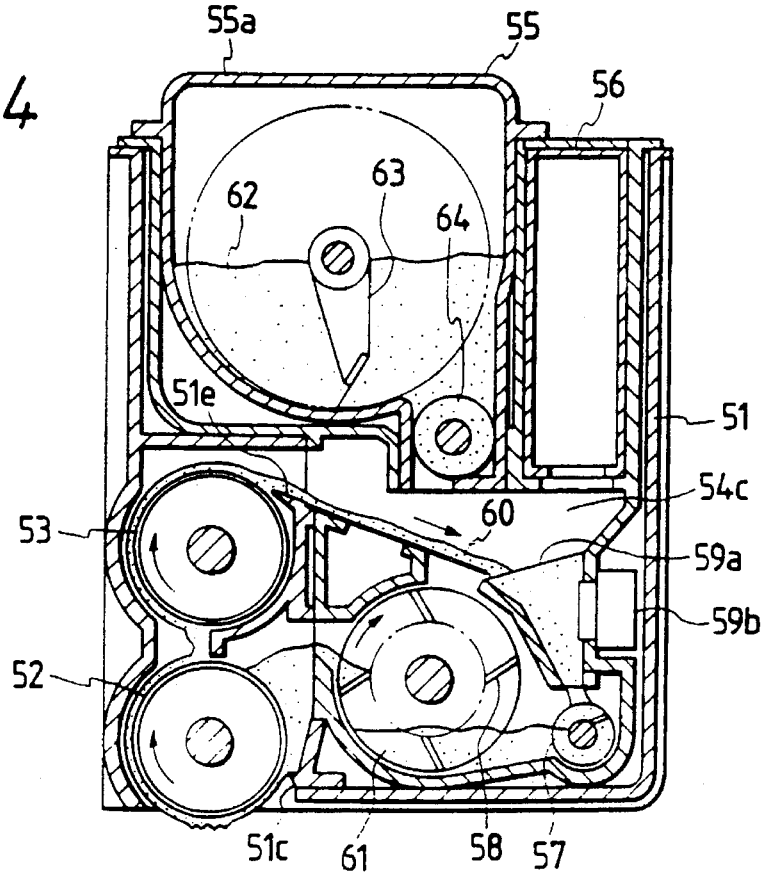
FIG. 4 is a vertically cross-sectional side view showing one embodiment of the working state of the developing apparatus having the developing agent accommodating cartridge according to the present invention.

In this first developing apparatus 50*a*, the developing agent accommodating cartridge unit 54 is fitted to the developing means frame unit 51, as shown in FIG. 2A and FIG. 2B, and the new developing agent 61 is thrown in the developing agent accommodating space 54*c* by peeling off the sealing member 56*a*, as shown in FIG. 3. Further, as shown in FIG. 4, by fitting the toner accommodating cartridge unit 55 to the developing agent accommodating cartridge unit 54, it can complete the motion operating possible condition.

Next, the driving means for driving this first developing apparatus 50*a* having the developing agent accommodating cartridge and the controlling means for controlling the color printer having the developing apparatus according to the present invention will be explained referring to the block diagram shown in FIG. 8.

A driving motor 81 for driving the first developing apparatus 50*a* comprises a communicating motor for driving each of the rotating members in the first developing apparatus 50*a*. The rotation of this driving motor 81 is transmitted to the various rollers through three electro-magnetic clutches 82, 83 and 84.

At first the rotation of this driving motor 81 is transmitted to the developing magnet roller 52 and the developing agent discharging and transporting roller 53 through the electro-magnetic clutch 82.

Next, this rotation is transmitted to the developing agent stirring roller 57 and the developing agent stirring and supplying roller 58 through the electro-magnetic clutch 83. Further, the rotation is transmitted to the toner stirring blade 63 and the toner supplementing roller 64 through the electro-magnetic clutch 84.

Figure 8:
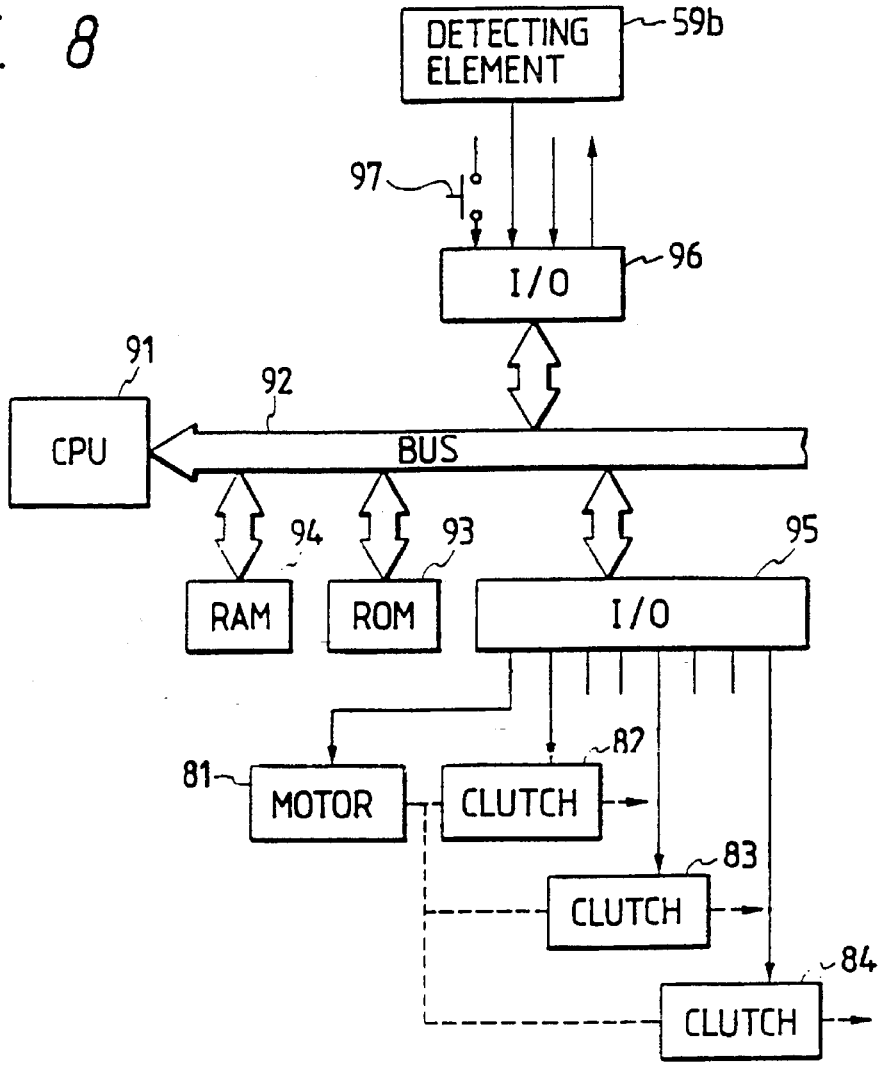
FIG. 8 is a block diagram showing one embodiment of the controlling means for controlling a color printer using the developing apparatus having the developing agent accommodating cartridge according to the present invention.

Among each of the electro-magnetic clutches 82, 83 and 84 and each of the rollers and the toner stirring blade 63, the gear mechanism etc. in the first developing apparatus 50*a*, is omitted from FIG. 8.

CPU 91 takes a leading part of the controlling means, and this CPU 91 is connected to a controlling program ROM 93, a controlling data RAM 94, an input connecting circuit 95 and an output connecting circuit 96 through a bus 92.

The input connecting circuit 95 connects to control the driving motor 81 and each of the electro-magnetic clutches 82, 83 and 84. Further, the output connecting circuit 96 connects to the toner concentration detecting element 59*b*, a developing agent recovery indicating switch 97 and other components of the color printer.

The driving means in each color of other developing apparatus 50*b*, 50*c* and 50*d* are constructed similarly to the above stated driving means in the first developing apparatus 50*a* and are connected to control similarly mentioned the above.

In the construction stated above, by controlling processing of CPU 91 the photosensitive belt 5 is rotated by operating a main driving motor (not shown) in the color printer. By operating the charging means 6, the photosensitive belt 5 is charged uniformly, and by modulating the laser beam 7*a* according to the yellow image information signal, accordingly the electrostatic latent image in response to the yellow image is formed.

Further, by operating a driving motor for driving the first developing apparatus 50*a* and the electro-magnetic clutches 82 and 83, thereby the first developing apparatus 50*a* is effected to carry out the operating condition.

In this condition, as shown in FIG. 4, the developing agent 61 in the developing agent accommodating space 54*c* is stirred by the developing agent stirring roller 57 and then the carriers and the toners are mixed uniformly and as well as the toners are charged electrostatically. In this time, the developing agent 61 is supplied to the developing magnet roller 52 according to the developing agent stirring and supplying roller 58.

The developing agent 61 supplied to the developing magnet roller 52 forms the magnetic brush by being adsorbed on the surface of the developing magnet roller 52, and by brushing and sliding on the surface of the photosensitive belt 5 the electrostatic latent image is developed. According to this developing process the electrostatic latent image is converted to the toner image having the yellow color.

Due to this developing process, when the toner mixture density lowers less than a predetermined value, CPU 91 recognizes this fact by the detected signal from the toner concentration detecting element 59*b*. And by operating the electro-magnetic clutch 84 during a predetermined time, the toner stirring blade 63 and the toner supplementing roller 64 are rotated and accordingly the supplementing toners are supplied.

The toner image of the yellow color formed on the surface of the photosensitive belt 5 is transferred to the intermediate transferring drum 8 in accordance with the rotating of the photosensitive belt 5.

After the developing process for the electrostatic latent image of the yellow color has been finished the developing agent 61 is recovered from the surface of the developing magnet roller 52 so that the developing agent 61 of the first developing apparatus 50*a* does not act on the photosensitive belt 5.

For the above controlling process, CPU 91 dis-energizes the electro-magnetic clutch 83 and then the rotation of the developing agent stirring roller 57 and the rotation of the developing agent stirring and supplying roller 58 are stopped.

Figure 5:
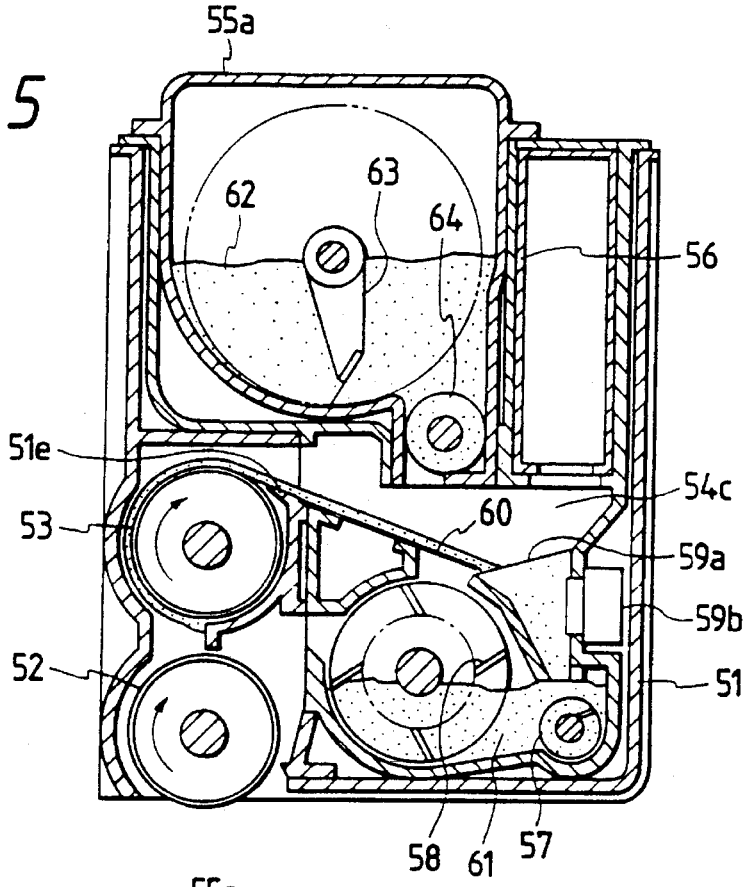
FIG. 5 is a vertically cross-sectional side view showing one embodiment of the recovery motion state of the developing agent in the developing apparatus having the developing agent accommodating cartridge according to the present invention.
Figure 6:
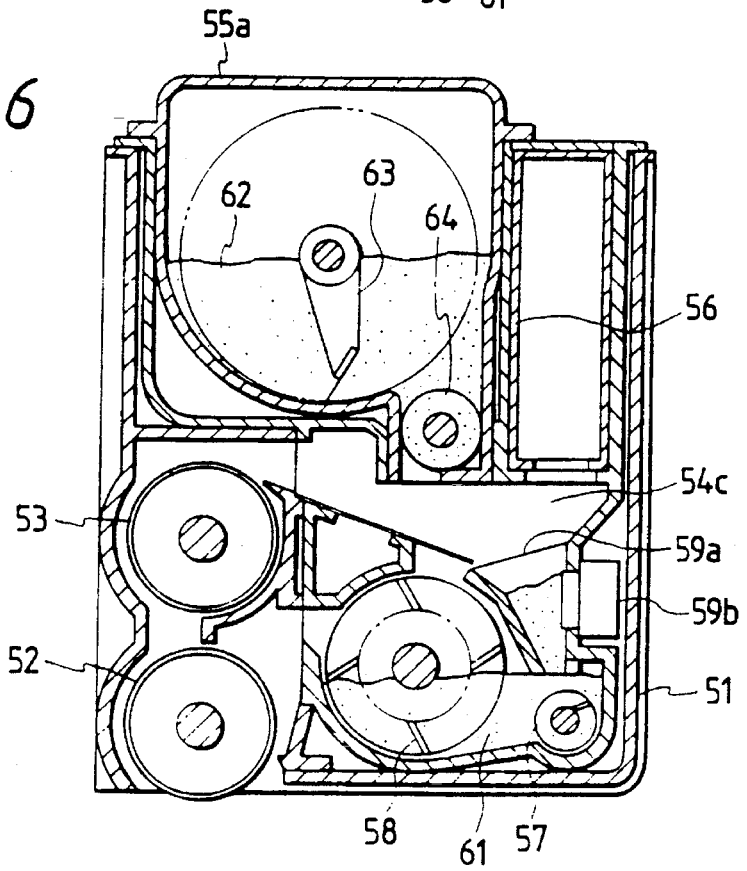
FIG. 6 is a vertically cross-sectional side view showing one embodiment of after the recovery of the developing agent in the developing apparatus having the developing agent accommodating cartridge according to the present invention.

In the above condition, as shown in FIG. 5, the developing agent supply for the developing magnetic roller 52 is stopped, the developing agent 61 of the surface of the developing magnetic roller 52 is scrapped and recovered. Accordingly, as shown in FIG. 6, all of the developing agent 61 on the surface of the developing magnetic roller 52 is recovered in the developing agent accommodating space 54*c* and thereby the magnetic brush vanishes.

In succession, the laser beam 7*a* is modulated according to the magenta image information signal and the electrostatic latent image in response to the magenta image is formed on the surface of the photosensitive belt 5.

So as to develop the magenta electrostatic latent image formed on the surface of the photosensitive belt 5, CPU 91 carries out the control against the second developing apparatus 50*b* similar to the control against the first developing apparatus 50*a*.

As a result, the magenta toner image, which is formed on the surface of the photosensitive belt 5 according to this control process, is transferred overlappingly with the former yellow toner image on the surface of the intermediate transferring drum 8. By practicing the above stated control process with the toner image formation of each color, the color toner image is completed on the surface of the intermediate transferring drum 8.

After that, by driving the recording paper feeding roller 13, the recording paper 12 is extracted, the color toner image is transferred and the transferred color image is fixed by the fixing means 17. After that the recording paper 12 is discharged through the recording paper discharging tray 19.

CPU 91 counts the printing (developing) sheet and the number of the counted printing sheets is accumulated in the controlling date RAM 94. When the number of the printing sheets reaches to the life of the developing agent 61 which becomes exhausted, CPU 91 informs that it reaches the timing for exchanging the developing agent 61.

In this time, at the controlling condition of the color printing mode, in each developing apparatus which has finished the developing process the developing agent 61 is recovered in the developing agent accommodating space 54*c* of the developing agent accommodating cartridge unit 54.

However, at the controlling condition of the single color printing mode, the developing agent recovering control is not carried out, besides the developing agent recovery indicating switch 97 is operated.

Figure 9:
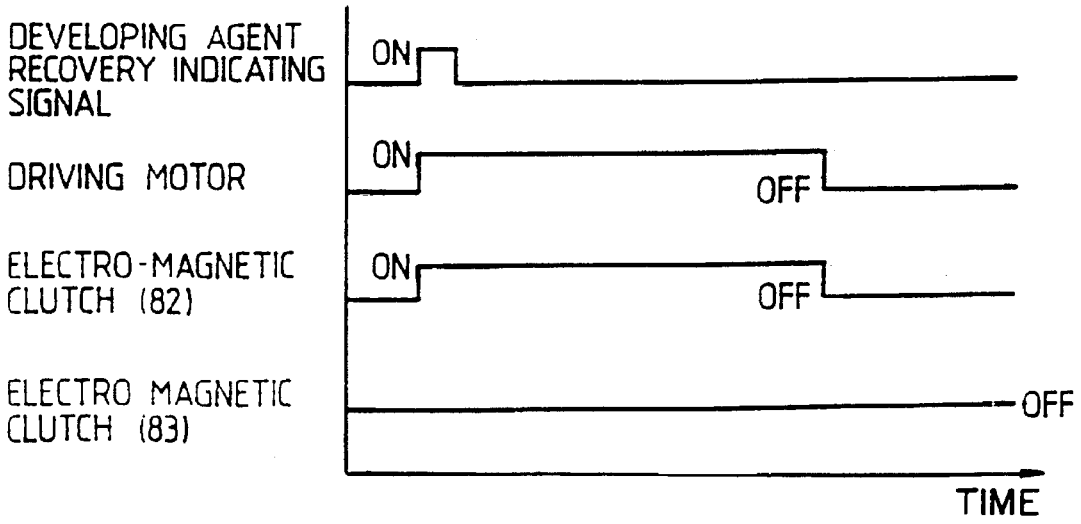
FIG. 9 is a timing chart showing one embodiment of the recovery control for controlling the recovery of the developing agent in the developing apparatus having the developing agent accommodating cartridge according to the present invention.

As shown in FIG. 9, CPU 91 generates the controlling signal for energizing the driving motor 81 and the electro-magnetic clutch 82 at a predetermined time by synchronizing the developing agent recovery indicating signal which is generated by the operation of the developing agent recovery indicating switch 97.

As stated above referring to FIG. 5 and FIG. 6, the developing agent 61 is recovered in the developing agent accommodating space 54*c* of the developing agent accommodating cartridge unit 54.

Figure 7A:
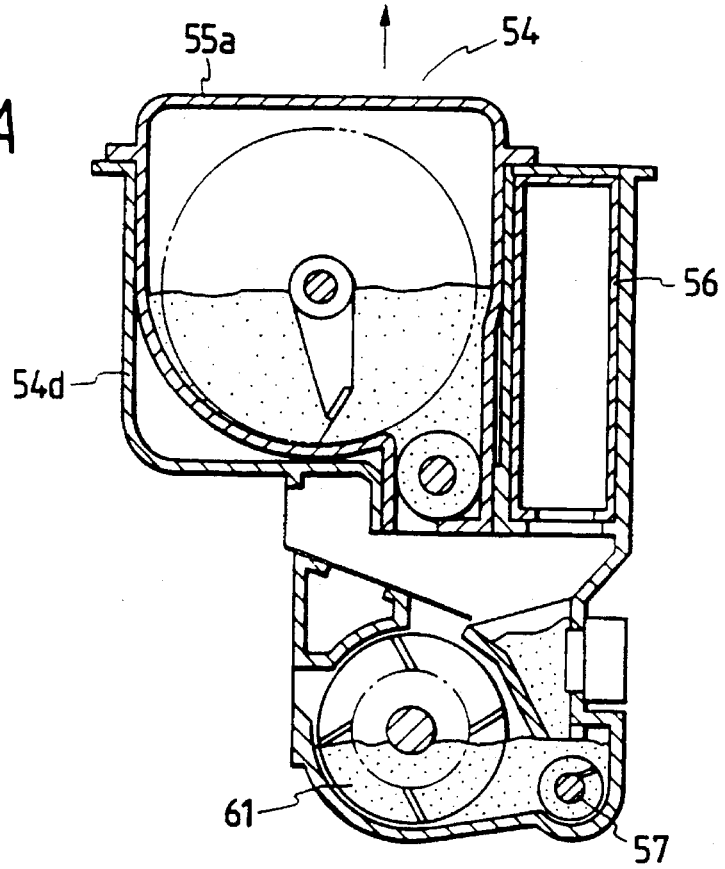
FIG. 7A is a vertically cross-sectional side view showing one embodiment of the developing agent accommodating cartridge unit of the developing apparatus according to the present invention.
Figure 7B:
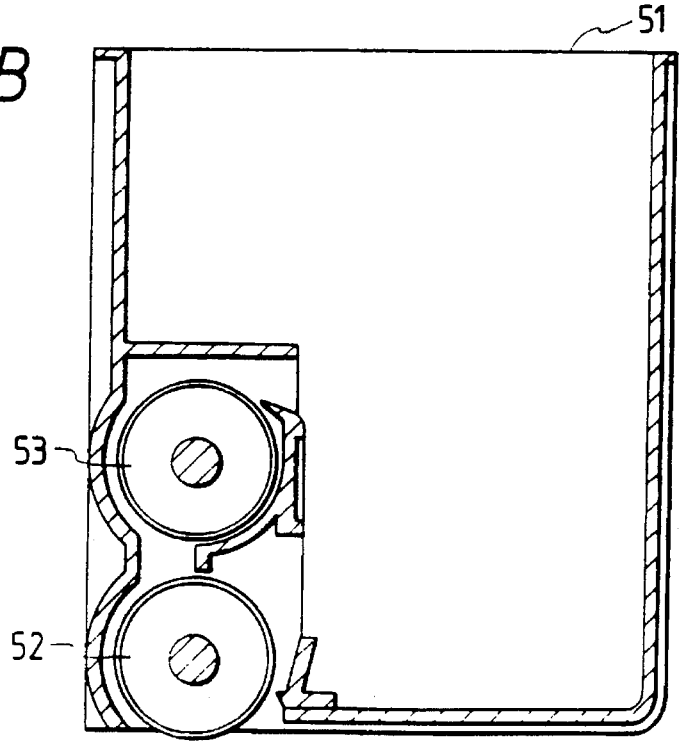
FIG. 7B is a vertically cross-sectional side view showing one embodiment of the working state for separating the developing agent accommodating cartridge unit from the developing means frame unit in the developing apparatus having the developing agent accommodating cartridge according to the present invention.

In the above condition, as shown in FIG. 7A and FIG. 7B, the developing agent accommodating cartridge unit 54 draws out from the developing means frame unit 51 and by fitting a new developing agent accommodating cartridge unit 54 it is possible to exchange easily the developing agent 61.

In the first developing apparatus 50*a*, the construction component has a high cost and it is necessary to position the developing magnet roller 52, accurately by employing the exchanging component construction as stated above, it can be installed permanently.

According to the above stated embodiment of the present invention, since the developing agent accommodating cartridge unit is exchanged by recovering the developing agent on the surface of the developing magnet roller and by separating the developing agent accommodating cartridge unit; from the developing means frame unit including the developing magnet roller, it is possible to exchange the developing agent at a low cost and without the lowering of the developing performance by inaccurately positioning the developing magnet roller.

Further, according to the above stated embodiment of the present invention, the developing agent accommodating container, which accommodates the new developing agent in the developing agent accommodating cartridge unit, is provided to introduce open and the new developing agent in the developing agent accommodating space. Therefore, developing agent accommodating cartridge unit having easy exchanged of the developing agent can be obtained.

We claim:

1. A developing apparatus having a developing container for accommodating a developing agent comprised of toners and carriers, said developing container having a developing roller for slidingly brushing a face of an electrostatic latent image by adhering the developing agent to an outer periphery surface thereof, and a recovering roller for recovering the toners on said developing roller which are not used for a development;

a developing agent accommodating cartridge member for accommodating recovered toners on said recovering roller and having a developing agent supplying roller for supplying the developing agent to said developing roller; and a toner accommodating cartridge member having a toner supplying roller which supplies the toners to said developing agent accommodating cartridge member, wherein said developing agent accommodating cartridge member and said toner accommodating cartridge member are detachably installed to said developing container.

2. A developing apparatus according to claim 1, wherein said toner accommodating cartridge member and said developing agent accommodating cartridge member are detachably installed as a single body to said developing container.

3. A developing apparatus according to claim 2, wherein said toner accommodating cartridge member is detachably connected to the developing agent accommodating cartridge member.

4. A developing apparatus according to claim 3, wherein said toner accommodating cartridge member is provided within the developing agent accommodating cartridge member.

5. A developing apparatus according to claim 2, wherein said toner accommodating cartridge member is provided within the developing agent accommodating cartridge member.

6. A developing apparatus according to claim 1, wherein said toner accommodating cartridge member is provided within the developing agent accommodating cartridge member.

7. A developing apparatus according to claim 1, further comprising a developing agent accommodating container provided within the developing agent accommodating cartridge member.

8. A developing apparatus according to claim 7, wherein the developing agent accommodating container is detachably provided within the developing agent accommodating cartridge member.

9. A developing apparatus according to claim 7, wherein said toner accommodating cartridge member, said developing agent accommodating cartridge member and said developing agent accommodating container are detachably installed as a single body to said developing container.

10. A developing apparatus according to claim 9, wherein said toner accommodating cartridge member is detachably connected to the developing agent accommodating cartridge member.

11. A developing apparatus according to claim 10, wherein the developing agent accommodating container is detachably provided within the developing agent accommodating cartridge member.

* * * * *